US008701885B2

(12) United States Patent
Koolhaas

(10) Patent No.: US 8,701,885 B2
(45) Date of Patent: Apr. 22, 2014

(54) CONTAINER SET

(75) Inventor: Ernst Christiaan Koolhaas, Nuenen (NL)

(73) Assignee: Fuji Seal International, Inc., Osaka-shi (JP)

( * ) Notice: Subject to any disclaimer, the term of this patent is extended or adjusted under 35 U.S.C. 154(b) by 0 days.

(21) Appl. No.: 13/389,714

(22) PCT Filed: Jul. 16, 2010

(86) PCT No.: PCT/JP2010/062046

§ 371 (c)(1),
(2), (4) Date: Feb. 9, 2012

(87) PCT Pub. No.: WO2011/021455

PCT Pub. Date: Feb. 24, 2011

(65) Prior Publication Data

US 2012/0138498 A1 Jun. 7, 2012

(30) Foreign Application Priority Data

Aug. 17, 2009 (JP) ..... 2009-188770

(51) Int. Cl.
*B65D 71/08* (2006.01)
*B65D 71/10* (2006.01)

(52) U.S. Cl.
CPC ..... *B65D 71/08* (2013.01); *B65D 71/10* (2013.01)
USPC ..... 206/432; 206/160; 206/510; 206/153

(58) Field of Classification Search
CPC ..... B65D 71/08; B65D 71/12; B65D 71/24; B65D 71/243; B65D 71/06; B65D 71/10; B65D 21/06; B65D 65/14; B65D 75/002; B65D 53/06; B65D 21/0204; B65D 21/0202; B65D 21/0201; B65D 21/02
USPC ..... 206/432, 427, 150, 497; 229/87.01, 229/934; 220/228, 288; 215/382; 53/463, 53/158; 294/87.2; 150/12
See application file for complete search history.

(56) References Cited

U.S. PATENT DOCUMENTS 2,008,659 A * 7/1935 Salfisberg ..... 383/37
3,812,962 A * 5/1974 Cunningham ..... 206/427

(Continued)

FOREIGN PATENT DOCUMENTS

CN 201472905 U * 5/2010
EP 0 395 370 B1 10/1990

(Continued)

OTHER PUBLICATIONS

International Search Report issued in International Application No. PCT/JP2010/062046 dated Oct. 26, 2010 (with translation).
Jan. 3, 2013 extended European Search report issued in European Patent Application No. 10809800.5.

*Primary Examiner* — Andrew Perreault
*Assistant Examiner* — James M Van Buskirk
(74) *Attorney, Agent, or Firm* — Oliff PLC

(57) ABSTRACT

A container set which connects and packages a plurality of containers with a package sheet is provided, wherein at least one container has a shape in which a plurality of large-width portions having a larger width in a connecting direction as compared with the other portions are formed on respective sides of a small-width portion having a smaller width than the large-width portion, with the small-width portion therebetween; the package sheet has a plurality of tubular portions which are shrunk along an outer shape of the containers and which individually store the containers; and, in the tubular portions, a connecting portion is formed between adjacent tubular portions at least at a part of the tubular portion corresponding to the large-width portion, and the tubular portions which oppose each other are separated from each other at the small-width portion, with no connecting portion formed.

10 Claims, 13 Drawing Sheets

(56) References Cited

U.S. PATENT DOCUMENTS

| | | | | |
|---|---|---|---|---|
| 4,099,616 | A * | 7/1978 | Klygis | 206/427 |
| 4,377,234 | A | 3/1983 | Kaplan | |
| 5,651,453 | A | 7/1997 | Olsen | |
| 6,050,058 | A * | 4/2000 | Loreto et al. | 53/411 |
| 7,021,479 | B2 * | 4/2006 | Pedmo et al. | 215/381 |
| 7,686,178 | B2 * | 3/2010 | Grant et al. | 215/384 |
| 7,832,553 | B2 * | 11/2010 | Hartness et al. | 206/150 |

FOREIGN PATENT DOCUMENTS

| | | | |
|---|---|---|---|
| FR | 2 637 866 | A1 | 4/1990 |
| FR | 2 733 733 | A1 | 11/1996 |
| JP | A-11-147564 | | 6/1999 |

* cited by examiner

CONTAINER SET

TECHNICAL FIELD

The present invention relates to a container set which connects a plurality of containers that are arranged substantially in a line while packaging the container with a package sheet.

BACKGROUND ART

Conventionally, a container set in which a plurality of containers are connected by a package sheet or a paper tray is well known, for facilitating carriage of the plurality of containers or clarifying the relationships among the plurality of containers. As such a container set, there are known a structure in which containers that are individually covered with a package sheet in advance are connected by means of a separate member such as a paper tray, and a structure in which the package sheets covering the containers are connected to each other. In the former case, there is an advantage that the structure can be applied to containers of various shapes, but the separate member such as the paper tray must be provided in addition to the package sheet, and, thus, there is a problem of increased cost and labor.

In the latter case, because the separate member such as the paper tray does not need to be provided, cost and labor may be saved. Such a type of the container set is disclosed in, for example, below-described Patent Literature 1-4. The container set of Patent Literature 1 is constructed by covering, on each container, each of a plurality of heat-shrinkable sleeves which are connected to each other, and heating the structure in this state to cause the heat-shrinkable sleeve to shrink. The container sets of Patent Literature 2-4 are constructed by covering the respective containers with tubular sheet members which are connected to each other.

RELATED ART REFERENCES

Patent Literature

[Patent Literature 1] French Patent No. 2733733
[Patent Literature 2] U.S. Pat. No. 4,377,234
[Patent Literature 3] French Patent No. 2637866
[Patent Literature 4] European Patent No. 395370

DISCLOSURE OF INVENTION

Technical Problem

However, each of the container sets of Patent Literature 1-4 has a problem in that only a cylindrical container having an approximately constant cross-sectional shape can be handled. In other words, in the related art, containers having a "neck portion" which partially has a smaller diameter cannot be connected without the use of the separate member such as the paper tray. As a result, increased cost and labor are required.

In consideration of the above, an advantage of the present invention is provision of a container set which can connect containers with a neck portion with only the package sheet and without the use of a separate member such as the paper tray.

Solution to Problem

According to one aspect of the present invention, there is provided a container set which connects a plurality of containers arranged substantially in a line while packaging the container with a package sheet, wherein each container has a shape in which a plurality of large-width portions, having a larger width in a direction of placement compared to other portions, are arranged along a vertical direction with small-width portions having a smaller width than the large-width portions therebetween, the package sheet has a plurality of tubular portions formed of a heat-shrinkable film which is shrunk along an outer shape of each container, and each tubular portion is connected to an adjacent tubular portion at least at apart of the large-width portion and is separated from the adjacent tubular portion at least at the small-width portion.

According to another aspect of the present invention, preferably, in the container set, at a connecting portion between adjacent tubular portions, a perforated line which facilitates cutting of the connecting portion is formed.

According to another aspect of the present invention, preferably, the container set further comprises a band portion which is shrunk in a state where the band portion surrounds all of the plurality of containers, to restrict movement of the plurality of containers, and which is partially connected to and partially separated from each tubular portion. In this case, preferably, the band portion is provided on at least one of an upper side and a lower side of the tubular portion.

Advantageous Effects of Invention

According to various aspects of the present invention, adjacent tubular portions are partially connected and partially separated at other portions. As a result, the tubular portion can appropriately follow even a complex container shape, and the corresponding container can be appropriately packaged. Also, as a result, even containers having a neck portion can be connected with only the package sheet.

BEST MODE FOR CARRYING OUT THE INVENTION

Figure 1:
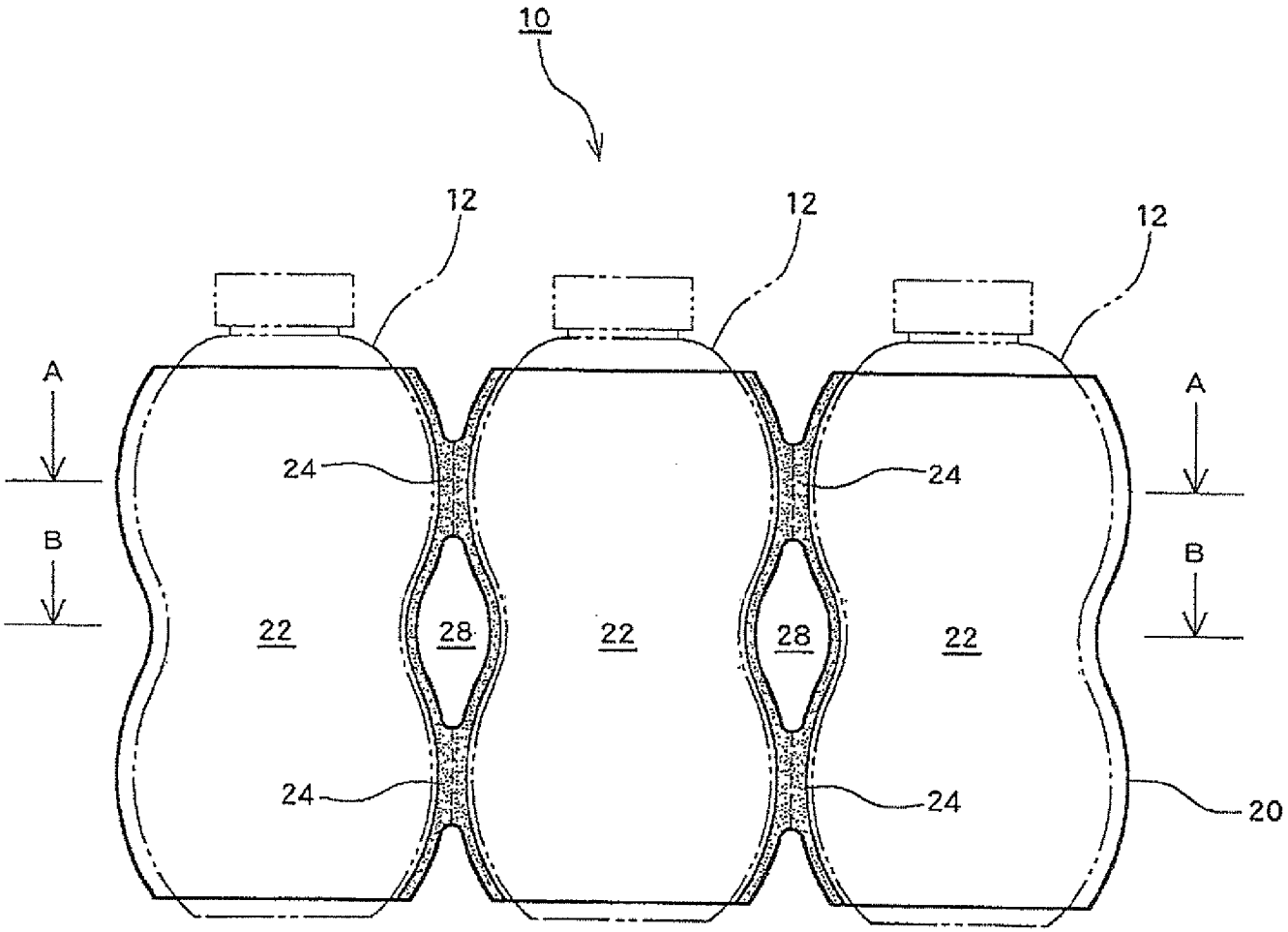
FIG. 1 is a front view of a container set according to a preferred embodiment of the present invention.
Figure 2:
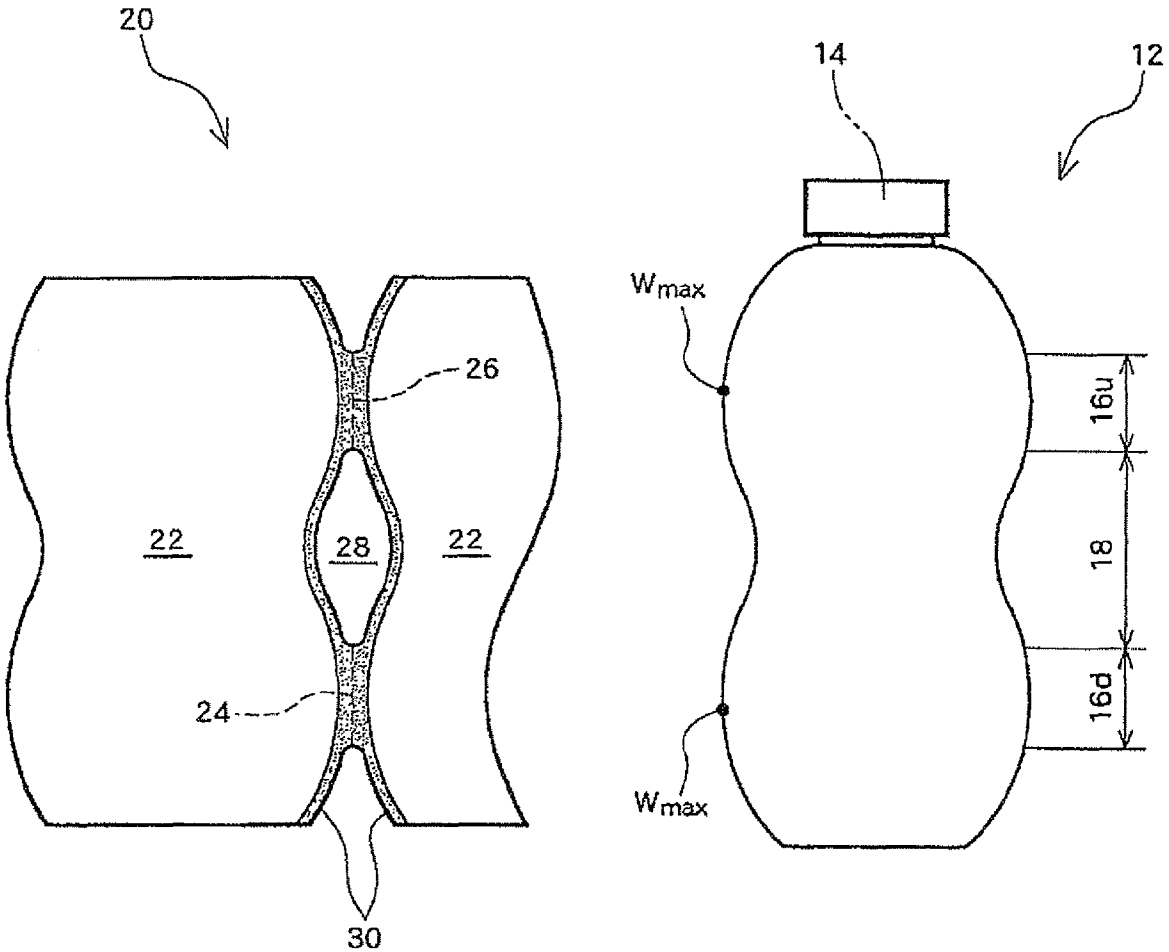
FIG. 2 is a front view of a package sheet and a container, with illustration of apart of the package sheet and container omitted.
Figure 3A:
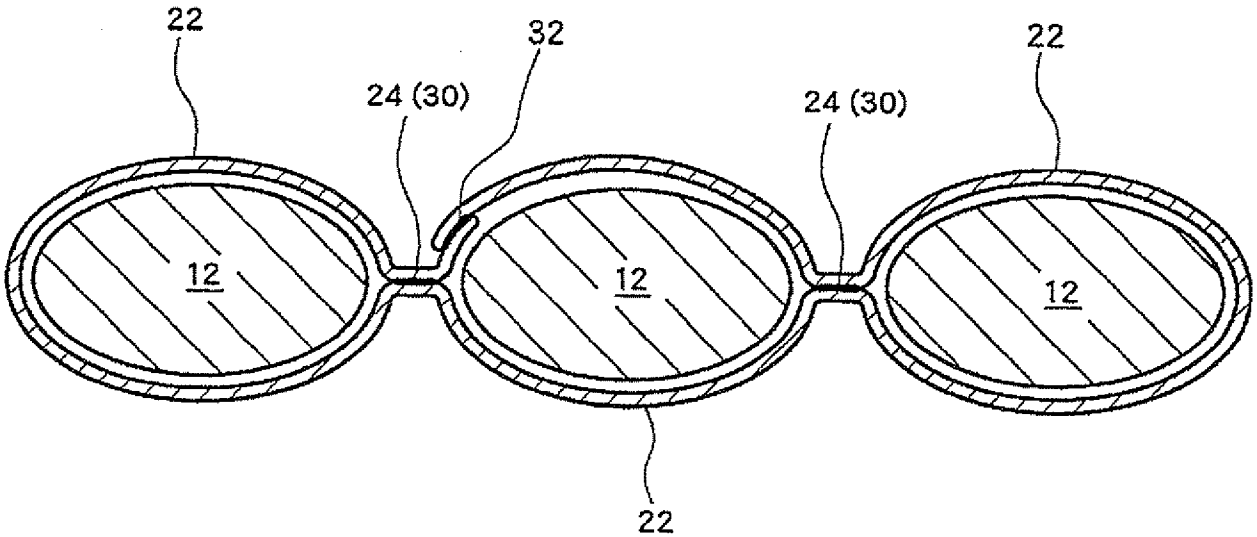
FIG. 3A is a cross sectional diagram taken at A-A in FIG. 1.
Figure 3B:
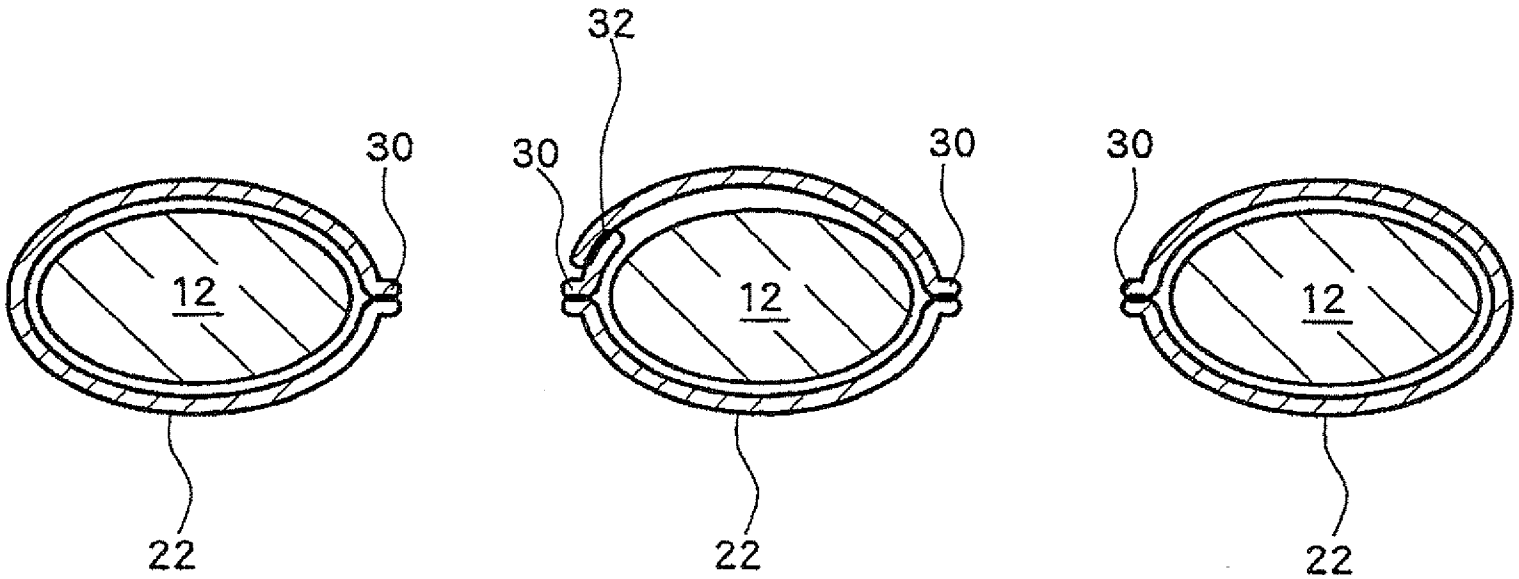
FIG. 3B is a cross sectional diagram taken at B-B in FIG. 1.

Preferred embodiments of the present invention will now be described with reference to the drawings. FIG. 1 is a front view of a container set 10 according to a preferred embodiment of the present invention. FIG. 2 is a front view of a package sheet 20 and a container 12, with illustration of a part of the package sheet 20 and the container 12 omitted. FIG. 3A is a cross sectional diagram taken at A-A in FIG. 1, and FIG. 3B is a cross sectional diagram taken at B-B in FIG. 1. In each drawing, in order to facilitate understanding, sizes of various members, such as a thickness of the package sheet 20, are set different from the actual sizes.

The container set 10 of the present embodiment is a structure in which a plurality (three in FIG. 1) of containers 12 are packaged by the package sheet 20 and connected to each other while being arranged in a line. Each of the three connected containers 12 is a hollow structure with a lid 14 mounted on an upper end, and the inside thereof is filled with a commercial product such as liquid, powder, etc. Each container 12 has, as viewed from the front, an approximate gourd shape with upper and lower portions round and the center portion narrowed. In other words, in the container 12 of the present embodiment, a width in the container placement direction (left and right direction in FIG. 1) in the container set 10 is set such that two large-width portions 16*u* and 16*d* having a relatively large-width (hereinafter, the reference letters will be omitted when the upper and lower portions are not to be distinguished from each other, and the structure will be referred to as a "large-width portion 16") are arranged along a vertical direction with a small-width portion 18 having a smaller width than the large-width portion 16 therebetween. The two large-width portions 16 arranged along the vertical direction; that is, each of the upper large-width portion 16*u* and the lower large-width portion 16*d* has a maximum-width portion Wmax of the container 12. The maximum-width portion Wmax is a position where the container 12 comes the closest to an adjacent container 12 when the containers 12 are arranged in a line. Therefore, the container 12 handled in the embodiment of FIG. 1 can also be described as having a plurality of portions which come the closest to the adjacent container 12 during arrangement, in a separated manner along the vertical direction.

An outer periphery of the container 12 is covered with the package sheet 20. The package sheet 20 is a sheet member on which various images necessary for the commercial product are printed, such as the name of the product, an image picture of the product, the material, a consume-by date, etc. With the container 12 covered with the package sheet 20, an outer appearance necessary for the "product" is attached to the container 12. In other words, the package sheet 20 is a necessary constituent element of the "product." In the present embodiment, a characteristic is that the plurality of containers 12 are connected using the package sheet 20 which is a constituent element necessary for the "product."

The connection of the plurality of containers 12 using the package sheet 20 is also disclosed in Patent Literature 1 or the like. However, such related art is targeted to an approximate cylindrical container having an approximate constant width, and is not targeted to a container having a plurality of maximum-width portions Wmax (that is, portions which come the closest with the adjacent container 12 when arranged) separately arranged along the vertical direction, as in the present embodiment. In the related art, when the containers 12 having the plurality of maximum-width portions Wmax separately arranged along the vertical direction are to be connected, normally, a separate member such as the paper tray must be used. Use of such a separate member results in increased cost and labor, and is not preferable. In the present embodiment, in order to solve such a problem, the containers 12 having a plurality of maximum-width portions Wmax separately arranged along the vertical direction are connected by the package sheet 20 covering the containers 12. The structure of the package sheet 20 will now be described in detail.

A material of which the package sheet 20 of the present embodiment is made is a heat-shrinkable film, and the package sheet 20 is mounted on the container by heating and shrinking the heat-shrinkable film. The heat-shrinkable film is a film having an anisotropic heat-shrinking percentage, and is a film that can be shrunk in a uniaxial direction by heating to an appropriate temperature. For example, the film is a film which shrinks by approximately 20%~90% during immersion in hot water of 90° C. for 10 seconds. Alternatively, the film may shrink by −3%~15% (negative number representing expansion) in a direction orthogonal to the uniaxial direction. Such a heat-shrinkable film may be formed by one type or a mixture of two or more types of thermoplastic resins selected from among a group of thermoplastic resins including a polyester-based resin, a polystyrene-based resin, a polyolefin-based resin, a vinyl chloride-based resin, etc. Among these materials, for example, a polyester-based resin such as polyethylene terephthalate (PET) may be selected when a hard characteristic is desired, or an olefin-based resin may be selected when a soft characteristic is desired. The heat-shrinkable film may be a film of a single-layer structure or a film of a multi-layer structure. Alternatively, the heat-shrinkable film may be a layered film in which a metal deposition layer, a foam resin layer, a nonwoven fabric, or the like and the heat-shrinkable film are layered. The overall thickness of the heat-shrinkable film is preferably approximately 20 μm to approximately 100 μm. By forming the package sheet 20 such that the film is a polyester-based resin and the uniaxial direction which is the stretching direction is set to a peripheral direction of a tubular portion 22, it is possible to strengthen a tearing strength between the containers at a connecting portion 24.

The heat-shrinkable film is such a synthesized resin film, and can be obtained by, for example, forming with a known method such as T-die method and an inflation method, and stretching the formed film. As the stretching process, the film is stretched primarily in one direction; for example, in a peripheral direction in the case of a tubular sheet, by a factor of approximately 2 times to approximately 8 times. Alternatively, the film may be stretched in a direction orthogonal to the one direction; for example, by a factor of approximately 1.5 times. The heat-shrinkable film thus manufactured shrinks, when heated, in a direction opposite the stretched direction.

In view of the structure of the shape, the package sheet 20 has a structure in which the containers 12 are provided with a plurality of the tubular portions 22 that are formed by forming a tubular shape such that the uniaxial direction of the heat-shrinkable film is set as the peripheral direction, and bonding the tubular shapes. Each tubular portion 22 has an approximate tubular shape covering the outer periphery of the corresponding container 12, and is shrunk along the outer shape of the container 12. Each of the plurality of tubular portions 22 is connected to the adjacent tubular portion 22 at least at a part of the large-width portion 16, and is separated from the adjacent tubular portion 22 at other portions including at least the small-width portion 18. In other words, there is employed a structure in which, at a region between the container 12 and another container 12 arranged in a line, the connecting portions 24 with the adjacent tubular portion 22 are arranged along the vertical direction with a through hole 28, formed at a height position corresponding to the small-width portion 18, therebetween. The plurality of containers 12 are connected to each other through the connecting portions 24.

In this manner, with a structure in which the adjacent tubular portions 22 are partially connected and are separated in other portions, the separated portion such as the through hole portion 28 can be shrunk to form the tubular portion 22 into a shape conforming with the outer shape of the container while the plurality of containers 12 are connected by the tubular portion 22 (package sheet 20). With such a configuration, even for the container in which the plurality of maximum-width portions Wmax (that is, portions which come the closest to the adjacent container 12 during arrangement) are separately arranged along the vertical direction, the containers 12 can be connected with only the package sheet 20, which is a necessary element for the "product" while maintaining superior appearance. As a result, cost and labor during manufacture of the container set 10 can be reduced.

A boundary portion between the tubular portion 22 and another tubular portion 22 including the connecting portion 24; that is, the portion with a gray hatching in FIG. 1, is a bonding portion in which a plurality of overlapped sheets are bonded by an adhesive or the like (hereinafter referred to as "boundary bonding portion 30"). The boundary bonding portion 30 divides the package sheet 20 into the plurality of tubular portions 22. As is clear from FIG. 3B, the boundary bonding portion 30 is a bump which projects in a direction toward the outside of the container 12 at the portions other than the large-width portion 16 (for example, the small-width portion 18). A width of the boundary bonding portion 30 is adjusted such that the projected amount of the bump is within a range which does not cause problems in appearance.

As will be described in detail later, in the present embodiment, both ends of a heat-shrinkable film are bonded to form a tubular shape, and the tubular film is bonded at appropriate positions to divide the film into a plurality of tubular portions 22. Because of such a method of manufacturing, on the package sheet 20, in addition to the boundary bonding portion 30 described above, a bonding portion (refer to FIG. 3) provided for connecting the two ends of a heat-shrinkable film to form a tubular shape is also formed. In the following, this bonding portion will be referred to as a "connection bonding portion 32" to distinguish this portion from the boundary bonding portion 30 provided on the boundary portion between a tubular portion 22 and another tubular portion 22. By providing the connection bonding portion 32 near the boundary bonding portion 30 as shown in FIG. 3, it is possible to set the bump portion due to the overlapping of the connection bonding portion 32 at a position which is not normally easily touched by the user or the like, and marketability can be improved.

When the user actually uses the product of the container set 10 thus configured, the user separates each container 12 from the other containers, and sets each container in an independent state from the other containers. In order to facilitate this operation to separate the containers 12, a perforated line 26 for facilitating cutting of the connecting portion 24 is formed in a straight line from an upper end to a lower end on the connecting portion 24 between the tubular portion 22 and another tubular portion 22. The perforated line 26 is for facilitating breaking of the package sheet 20, and there may be employed, for example, a perforated line in which a cutout portion and connected portion are alternately formed, or a groove line (half-cut line) having a depth which is less than the thickness of the package sheet 20 (heat-shrinkable film). By providing such a perforated line 26, the user can easily separate the containers 12 without the use of a tool such as scissors.

Figure 4:
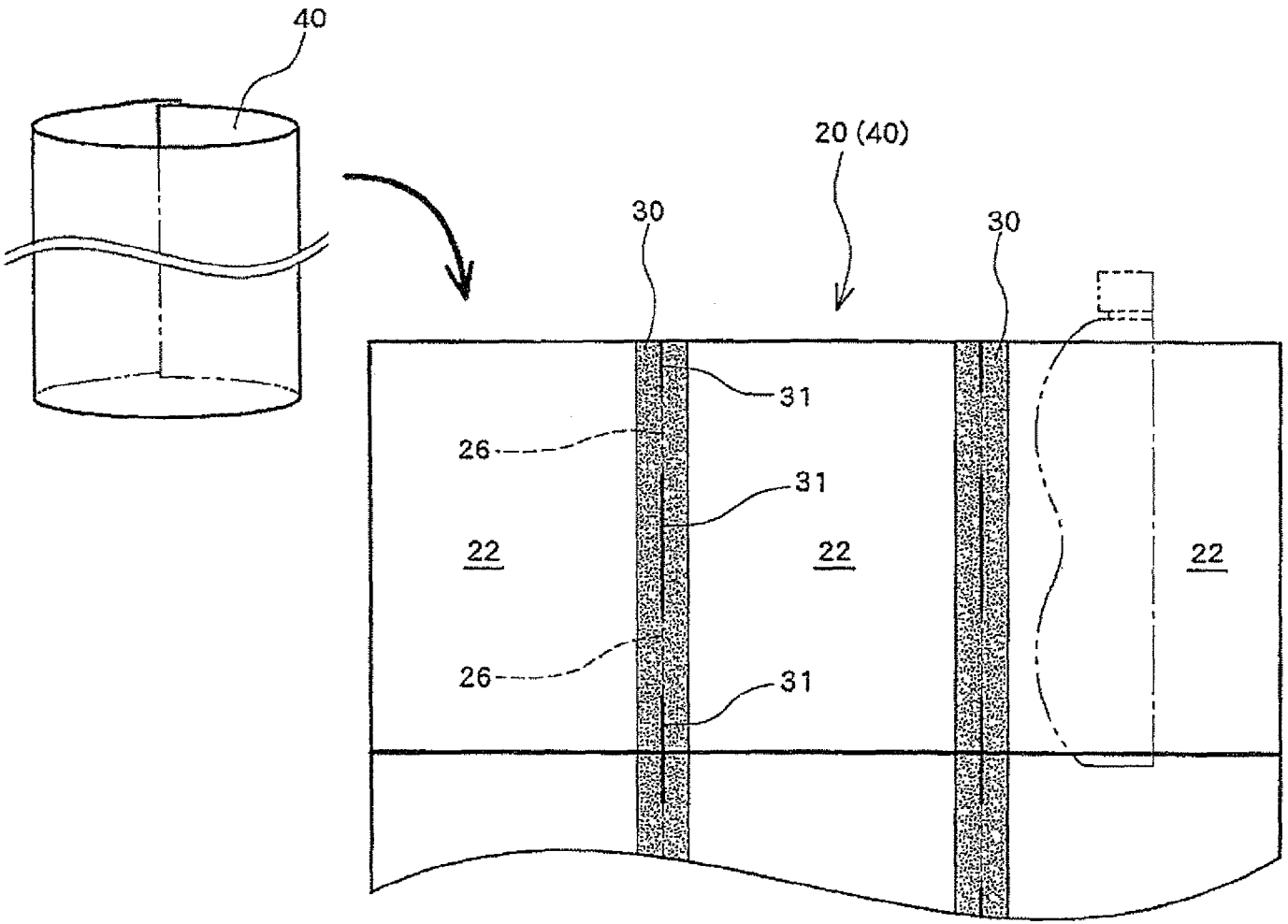
FIG. 4 is an image diagram showing manufacture of a package sheet.

Next, a method of manufacturing such a package sheet 20 will be described with reference to FIG. 4. As already described, when the package sheet 20 is manufactured, first, the two ends of a heat-shrinkable film are bonded by an adhesive or the like in a state where the ends are overlapped with each other, to form one large tubular sheet 40. The tubular sheet 40 is later cut according to the height of each container 12, and, therefore, at this point, the tubular sheet 40 has a significantly longer length as compared with the container 12.

In parallel to the formation operation of the tubular sheet 40 (that is, the formation operation of the connection bonding portion 32), or after the tubular sheet 40 is formed, the tubular sheet 40 is divided into three tubular portions 22. More specifically, the overlapped films are bonded in a straight line at positions where the tubular sheet 40 is equally divided into three in the lateral direction. With this bonding operation, the structure which has been one large tubular sheet is divided into three tubular portions 22 connected to each other through the boundary bonding portions 30.

When the three tubular portions 22 are formed, next, a cutout line 31 and the perforated line 26 are applied at an approximate center portion of the width of the boundary bonding portion 30. Positions and lengths of the cutout line 31 and the perforated line 26 are determined according to the shape of the container 12 to be covered. More specifically, the perforated line 26 is applied in a height range approximately the same as that of the portion, of the large-width portion 16 of the package sheet 20, desired to be set as the connecting portion 24 even after the shrinkage. The cutout line 31 is applied to a height range approximately the same as that of a portion desired to be contracted and shrunk along the surface of the container 12 even after the package sheet 20 is shrunk; that is, the portion other than the connecting portion 24. After the cutout line 31 and the perforated line 26 are formed, the long-length tubular sheet is cut to a length corresponding to the height of the target container 12.

The package sheet 20 obtained by such a process is set on the containers 12 such that the containers 12 are positioned inside the tubular portions 22. The package sheet 20 is heated in this state, so that the tubular portions 22 shrink according to the outer shape of the container 12. Because the height range over which the cutout line 31 is applied is separated from each of the adjacent tubular portions 22, this range is not affected by the tubular portion 22, and can be freely deformed (shrunk). As a result, this portion can reliably follow and shrink in a neck portion such as the small-width portion 18, and a package state of superior appearance can be realized. On the other hand, the height range where the perforated line 26 is applied; that is, the height range approximately the same as that of the large-width portion 16, is still connected to the adjacent tubular portion 22. As a result, the plurality of containers 12 can be connected to each other without using a separate member such as the paper tray. In other words, according to the present embodiment, even when the containers 12 have a special shape with the neck portion, the plurality of containers 12 can be connected to each other with only the package sheet 20 while maintaining superior appearance.

Figure 5:
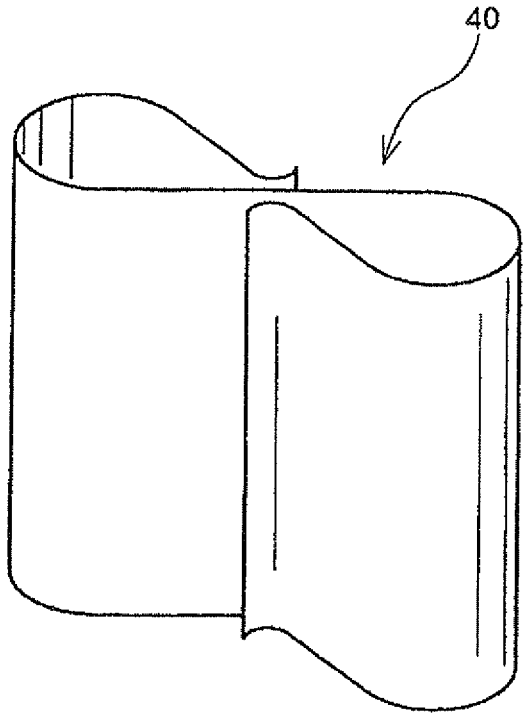
FIG. 5 is an image diagram showing manufacture of another package sheet.

The manufacturing process described herein is merely exemplary, and the order of the operations or the like may be suitably changed. In addition, the method of folding the sheet or the like for forming the tubular portion 22 may be suitably changed. For example, in the present embodiment, in order to connect three containers 12, one large tubular sheet 40 is divided into three tubular portions 22. However, when only two containers 12 are to be connected, for example, as shown in FIG. 5, one heat-shrinkable film 40 may be folded in an approximate "8" shape, and the two ends and the center of the heat-shrinkable film 40 may be bonded in an overlapping manner, to form two tubular portions 22. When a portion where three sheets overlap is formed, the overlapped portion is the boundary bonding portion 30 which is the boundary portion of the two tubular portions 22, and is also the connecting portion 24 connecting the two containers 12. The portion where three sheets are overlapped is harder and has a higher strength as compared with other portions. By setting such a portion as the connecting portion 24, it is possible to reliably prevent unintentional damage of the connecting portion 24, and, consequently, unintentional separation of the containers 12.

Figure 6:
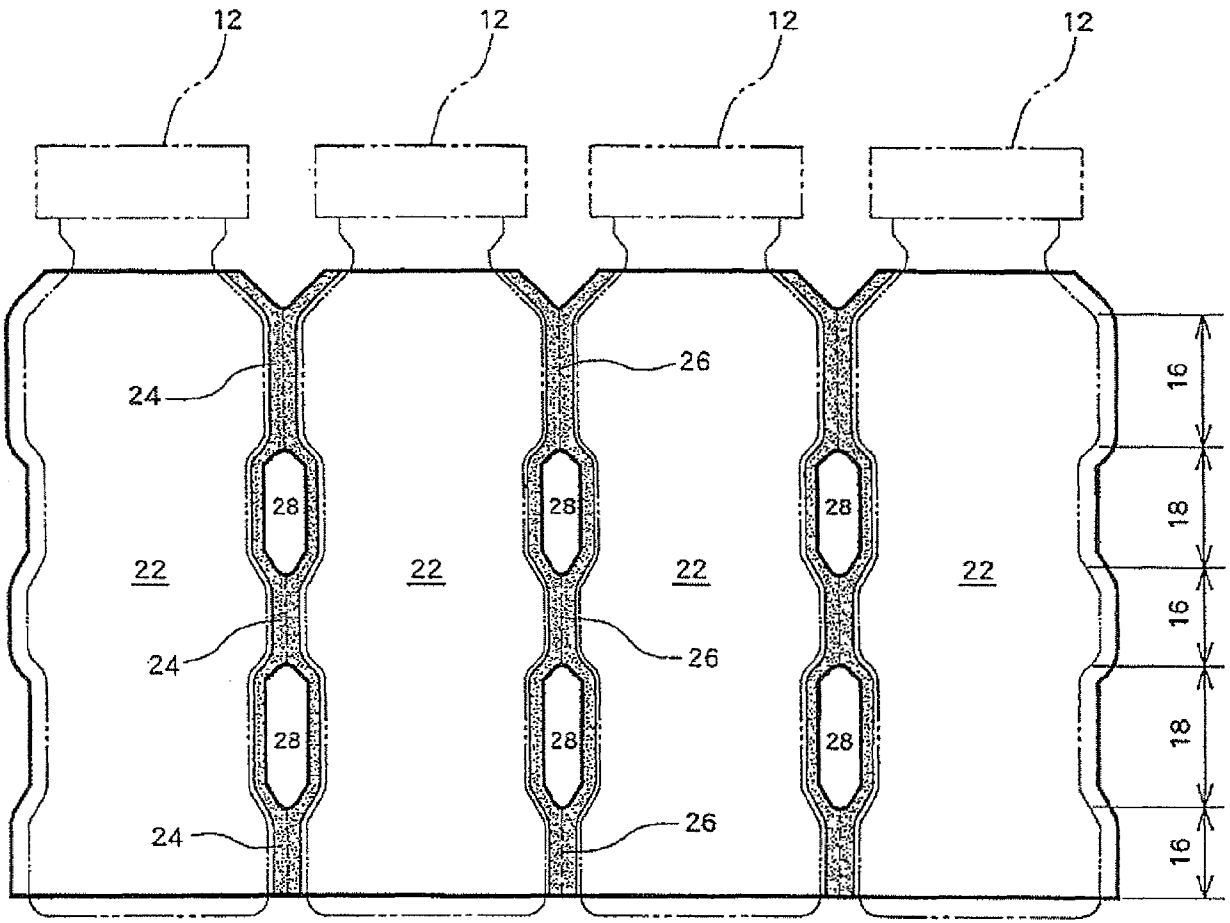
FIG. 6 is a front view of another container set.

In addition, in the above description, in the container set 10, three containers 12 having two large-width portions 16 are connected, but the number of the large-width portions 16 may be three or more, and the number of connection of the containers 12 may be any number greater than or equal to 2. For example, as shown in FIG. 6, the container set may be targeted to the containers 12 having three large-width portions 16 arranged along the vertical direction with the small-width portions 18 therebetween. In this case, three connecting portions 24 are arranged along the vertical direction between each container 12 and another container 12. In addition, the number of connection positions of the containers 12 may be four or the like.

Figure 7:
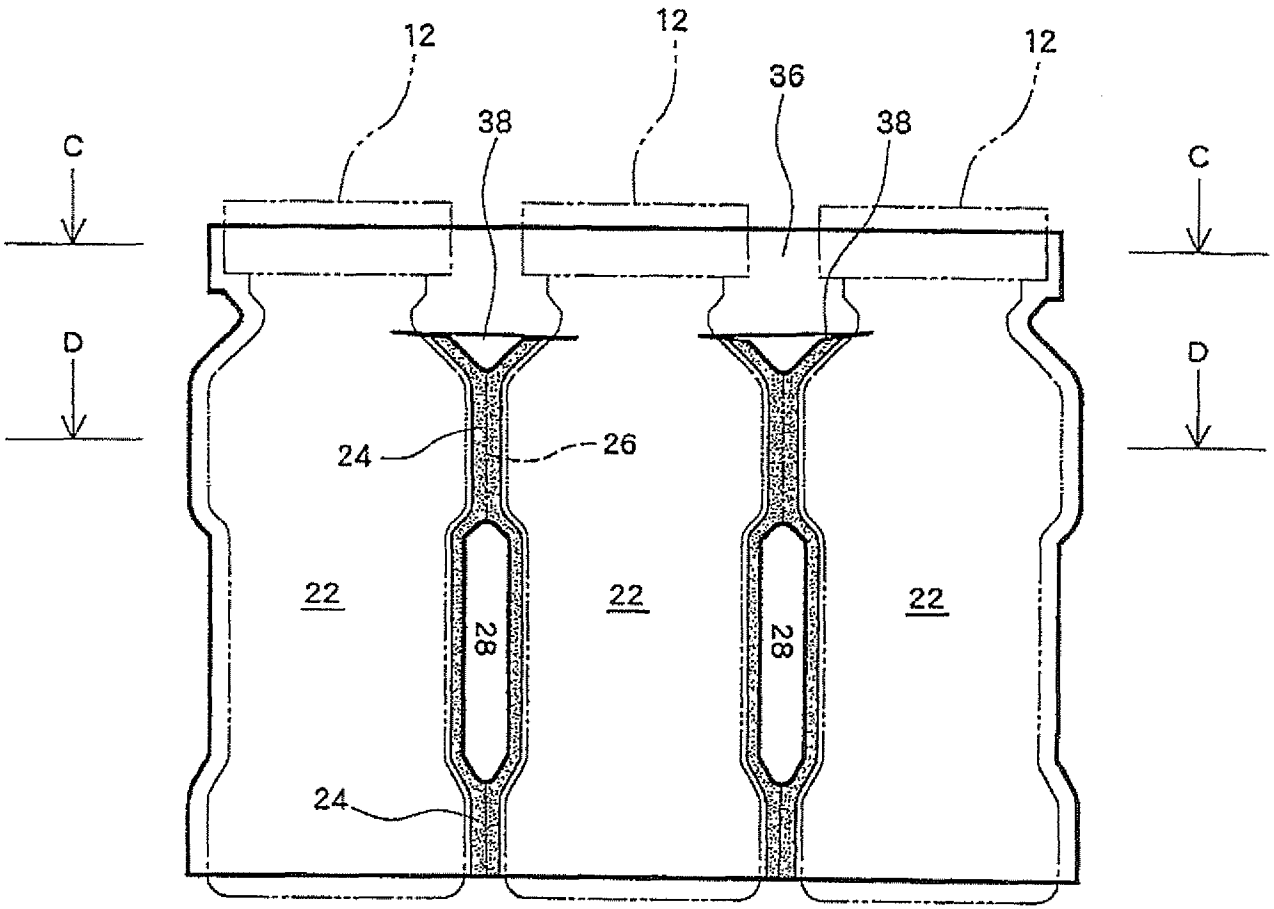
FIG. 7 is a front view of another container set.
Figure 8A:
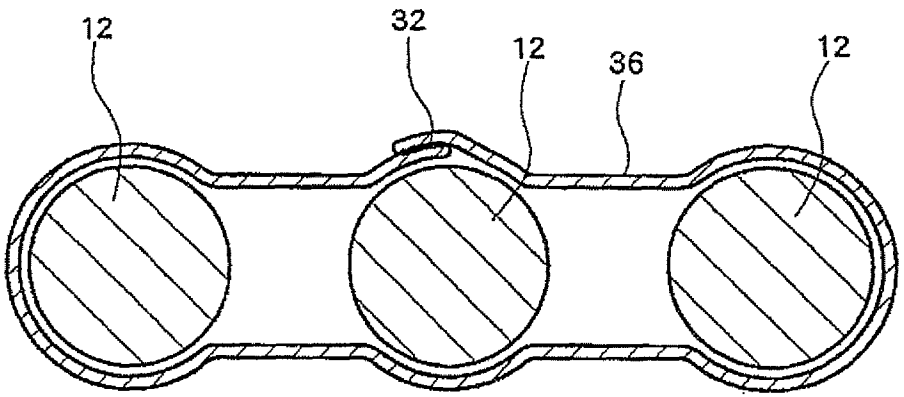
FIG. 8A is a cross sectional diagram taken at C-C in FIG. 7.
Figure 8B:
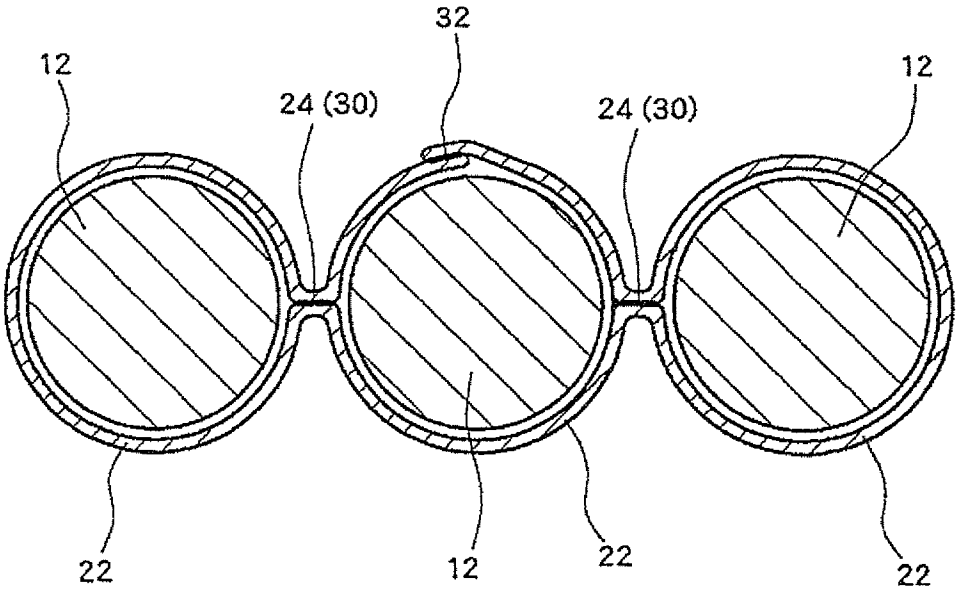
FIG. 8B is a cross sectional diagram taken at D-D in FIG. 7.

Moreover, in the above description, a form in which the containers are connected with only the plurality of tubular portions 22 is exemplified, but alternatively, a constituent element other than the tubular portion 22 may be added to the package sheet 20. For example, in addition to the plurality of tubular portions 22 for individually covering the containers 12, a band portion 36 which restricts the movement of the plurality of containers 12 may be provided on the package sheet 20 over all of the plurality of containers 12. Such a configuration will now be described with reference to FIGS. 7-9. FIG. 7 is a front view of a container set 10 of another preferred embodiment of the present invention, FIG. 8A is a cross sectional diagram taken at C-C in FIG. 7, FIG. 8B is a cross sectional diagram taken at D-D in FIG. 7, and FIG. 9 is a diagram showing a state, before shrinkage, of the package sheet 20 used in the container set 10.

The band portion 36 as described before may be provided on an upper end of the tubular shape 22 as shown in FIG. 7 or at a lower end of the tubular portion 22. The band portion 36 is partially connected to the tubular portions 22 and also partially separated from the tubular portions 22 by a cutout portion 38 formed on an end of the tubular portion 22. On the band portion 36, the boundary bonding portion 30 is not provided, and the band portion 36 is formed in one large ring surrounding all of the plurality of containers 12. By the band portion 36 being shrunk in a state where the band portion 36 surrounds all of the plurality of containers 12, as shown in FIG. 8A, the movement of the plurality of containers 12 is restricted by the band portion 36, and the connected state can be more stably maintained.

Figure 9:
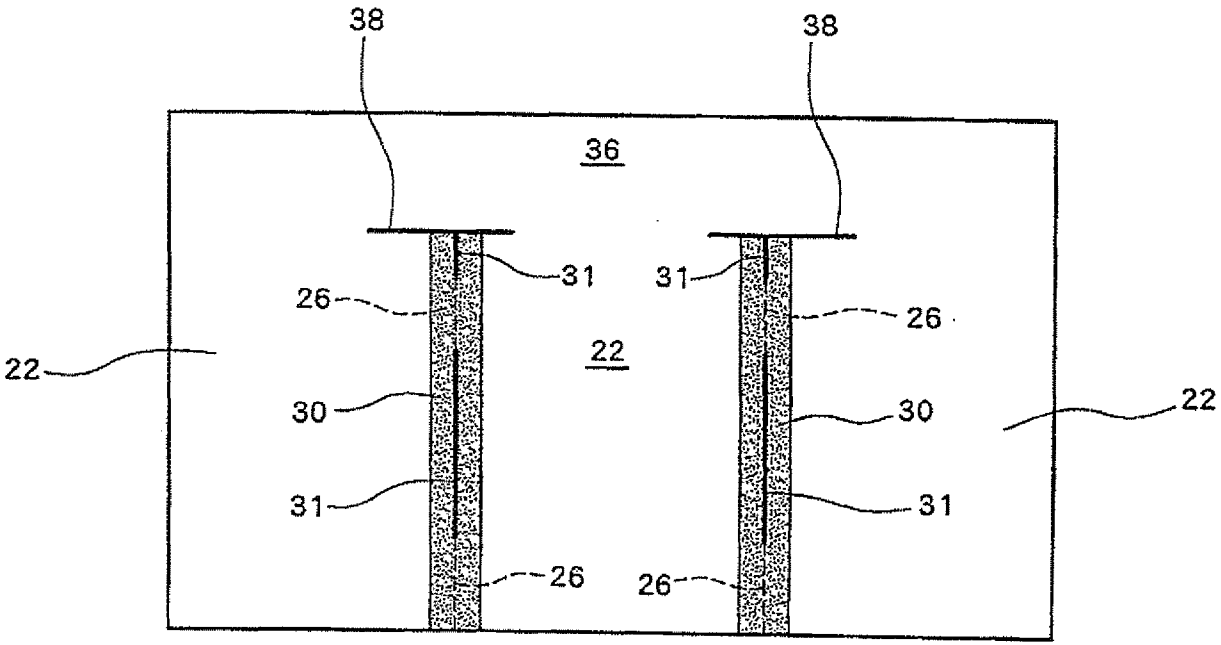
FIG. 9 is a diagram showing a package sheet used in the container set of FIG. 7, before a shrinking process.

FIG. 9 is a front view of the package sheet 20 having such a band portion 36, before the shrinking process. Before shrinking, the package sheet 20 has three tubular portions 22 divided by the boundary bonding portions 30, and the band portion positioned on an upper side of the tubular portion 22. The cutout 38 is applied only partially at the boundary between the tubular portion 22 and the band portion 36, so that the tubular portion 22 and the band portion 36 are only partially connected. The structure is heated in a state where the container 12 is positioned inside of each tubular portion 22 of the package sheet 20, so that the container set 10 as shown in FIG. 7 is obtained.

When the container 12 is individually taken out and used, the band portion 36 can be expected to become an obstacle. Therefore, desirably, a perforated line such as a perforated line is applied on the connecting portion between the band portion 36 and the tubular portion 22 (portion, of the boundary portion between the band portion 36 and the tubular portion 22, in which the cutout portion 38 is not applied), in order to allow easy removal of the band portion 36 during use.

Figure 10:
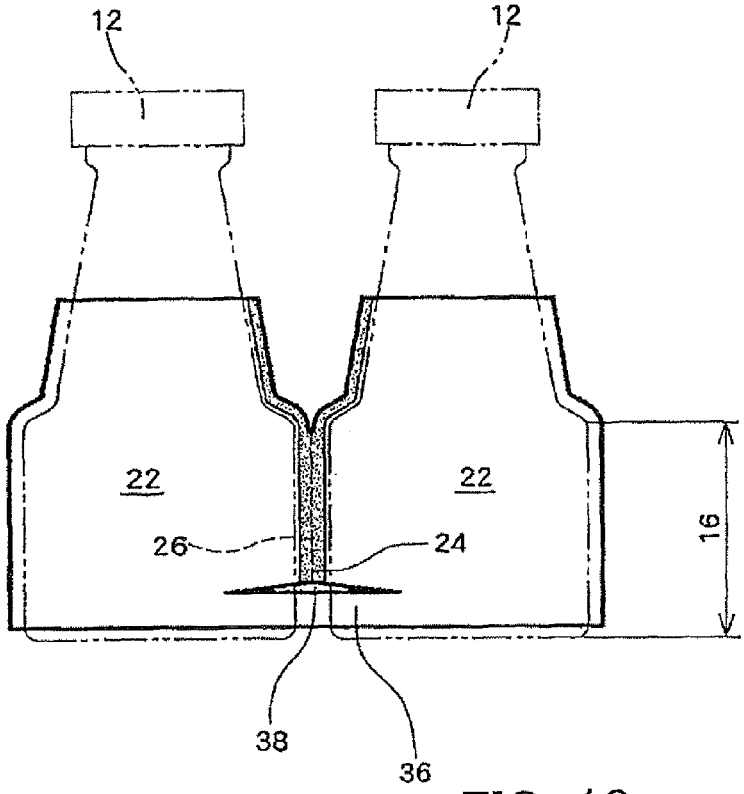
FIG. 10 is a front view of a container set exemplified as a reference.

In addition, the band portion 36 is also effective for a container set 10 in which a plurality of containers 12 having only one large-width portion 16 are connected. FIG. 10 is a schematic front view of a container set 10 shown as a reference. As shown in FIG. 10, when a plurality of containers 12 having only one large-width portion 16 having the maximum width are connected at each tubular portion 22, only one connecting portion 24 is present between the tubular portions 22. In this case, if the band portion 36 is not provided, the containers 12 can be relatively easily moved with the connecting portion 24 serving as an axis, and there is a problem in that the positional relationship between the containers 12 cannot be fixed. On the other hand, as shown in FIG. 10, when a pair of band portions 36 are provided on a near side and far side of the front view of FIG. 10 at a lower end of the tubular portion 22, the band portion 36 which is shrunk by heat or the like achieves a tightening action of the containers 12, and, by a combined effect of the shrinking and fixing action of the container 12 at the connecting portion 24 and the tightening action of the overall containers 12 by the band portion 36, it is possible to reliably fix the positional relationship of the containers 12 with each other.

In the case where there is only one location of the connecting portion 24, the band portion 36 may be provided close to the connecting portion 24 so that the shrinking force during the thermal shrinkage of the band portion 36 can be easily received at the connecting portion 24 and the positional relationship of the containers 12 with each other can be more easily held after the shrinkage.

Figure 11A:
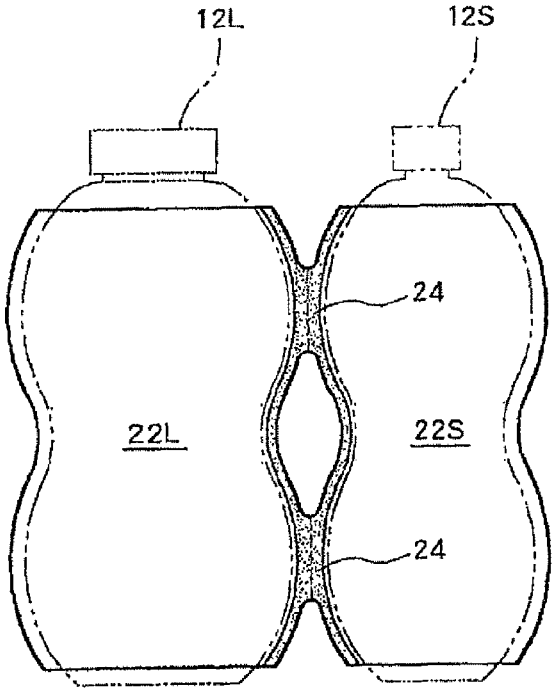
FIG. 11A is a front view of another container set.
Figure 11B:
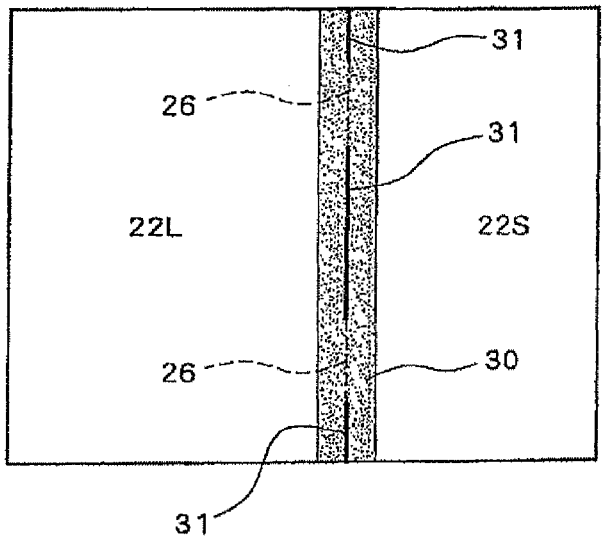
FIG. 11B is a diagram of a package sheet used in the container set of FIG. 11A, before a shrinking process.

Moreover, in the above description, there is exemplified a case in which all of the plurality of containers 12 have the same shape. Alternatively, containers 12 of different shapes may be connected, so long as the large-width portion 16 exists at a position of approximately the same height. For example, as shown in FIG. 11A, a larger gourd-shaped container 12L and a smaller gourd-shaped container 12S may be connected by a package sheet 20 having a plurality of tubular portions 22L and 225. When two types of containers 12 having different widths are connected in this manner, the sizes of the two tubular portions 22L and 225 are set to different sizes at the stage before the shrinking process. Specifically, as shown in FIG. 11B, the position of the boundary bonding portion 30 is adjusted so that the tubular portion 22L of a large size and the tubular portion 22S of a small size are aligned.

Figure 12:
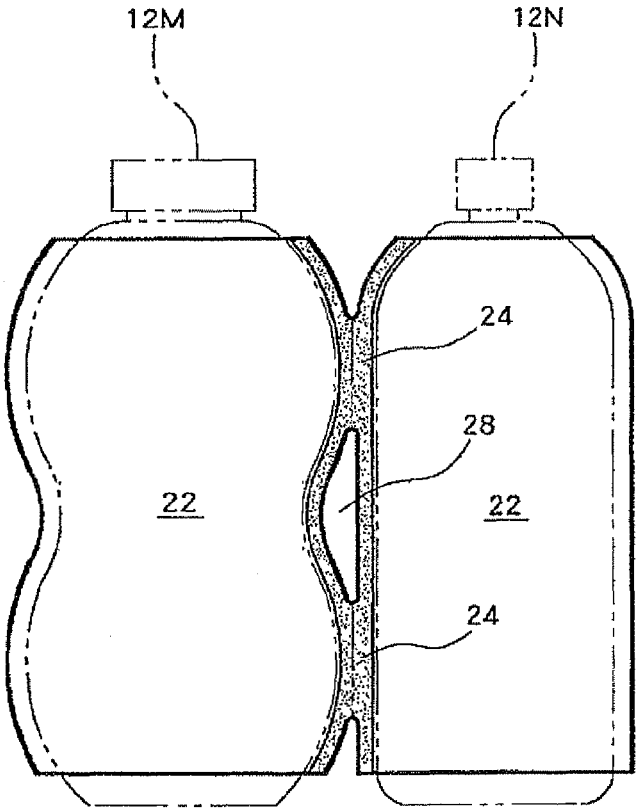
FIG. 12 is a front view of a container set exemplified as a reference.

In addition, it is only necessary that at least one of the plurality of containers of the container set 10 has a shape such that the plurality of large-width portions 16 are arranged separated in the height direction. Therefore, a cylindrically shaped container 12N having an approximately constant cross sectional shape may be included in the plurality of containers, as shown in FIG. 12.

In either case, by setting the tubular portion 22 covering the containers 12 in a shape in which the tubular portion 22 is connected to the adjacent tubular portion 22 at least at the large-width portion 16 and is separated from the adjacent tubular portion 22 at least at the small-width portion 18, it is possible to reliably connect a plurality of containers 12 with only the package sheet 20 while maintaining superior appearance.

EXPLANATION OF REFERENCE NUMERALS

10 CONTAINER SET; 12 CONTAINER; 14 LID; 16 LARGE-WIDTH PORTION; 18 SMALL-WIDTH POR-

TION; 20 PACKAGE SHEET; 22 TUBULAR PORTION; 24 CONNECTING PORTION; 26 PERFORATED LINE; 28 THROUGH HOLE; 30 BOUNDARY BONDING PORTION; 31 CUTOUT LINE; 32 CONNECTION BONDING PORTION; BAND PORTION; 38 CUTOUT PORTION

The invention claimed is:

1. A container set which connects and packages a plurality of containers with a package sheet, wherein at least one container has a shape in which a plurality of large-width portions having a larger width in a connecting direction as compared with the other portions, are formed on respective sides of a small-width portion having a smaller width than the large-width portion, with the small-width portion therebetween;

the package sheet has a plurality of tubular portions which are shrunk along an outer shape of the containers and which individually store the containers;

in the tubular portions, a connecting portion is formed between adjacent tubular portions at least at a part of the tubular portion corresponding to the large-width portion, and the tubular portions which oppose each other are separated from each other at the small-width portion, with no connecting portion formed; and each of the tubular portions covers the large-width portion and the small-width portion of the corresponding container along entire outer peripheries of the respective portions.

2. The container set according to claim 1, wherein at the connecting portion between the adjacent tubular portions, a perforated line which facilitates cutting of the connecting portion is formed.

3. The container set according to claim 1, further comprising:

a band portion which is shrunk in a state where the band portion surrounds all of the plurality of containers, to restrict movement of the plurality of containers, and which is partially connected to and partially separated from each tubular shape.

4. The container set according to claim 3, wherein the band portion is provided on at least one of an upper side and a lower side of the tubular portion.

5. The container set according to claim 2, further comprising:

a band portion which is shrunk in a state where the band portion surrounds all of the plurality of containers, to restrict movement of the plurality of containers, and which is partially connected to and partially separated from each tubular shape.

6. The container set according to claim 5, wherein the band portion is provided on at least one of an upper side and a lower side of the tubular portion.

7. The container set according to claim 1, wherein the package sheet has a first end and a second end, the first end overlapping the second end at a position adjacent to the connecting portion.

8. The container set according to claim 7, wherein there is a gap between small-width portions of adjacent tubular portions, and the first end and the second end overlap at a position adjacent to the gap.

9. A package member which is formed of a package sheet and connects and packages containers having a shape in which a plurality of large-width portions having a larger width in a connecting direction as compared with other portions, are formed on respective sides of a small-width portion having a smaller width than the large-width portion, with the small-width portion therebetween, wherein the package sheet has a plurality of tubular portions which are shrunk along an outer shape of the containers and which individually store the containers, and in the tubular portions, a connecting portion is formed between adjacent tubular portions at least at a part of the tubular portion corresponding to the large-width portion, and the tubular portions which oppose each other are separated from each other at the small-width portion, with no connecting portion formed, and each of the tubular portions covers the large-width portion and the small-width portion of the corresponding container along entire outer peripheries of the respective portions.

10. A method of manufacturing a container set which connects and packages a plurality of containers with a package sheet, the containers having a shape in which a plurality of large-width portions having a larger width in a connecting direction as compared with other portions, are formed on respective sides of a small-width portion having a smaller width than the large-width portion, with the small-width portion therebetween, the method comprising:

bonding portions of the package sheet to form a plurality of tubular portions which store the containers and a boundary bonding portion located between the tubular portions to separate the tubular portions;

forming a cutout line in a height range, in the boundary bonding portion, other than a height range corresponding to that of the large-width portion; and heating the package sheet in a state in which the containers are positioned inside the respective tubular portions to shrink the tubular portions in accordance with an outer shape of the containers.

* * * * *